US005537692A

United States Patent [19]

Dorr

[11] Patent Number: 5,537,692

[45] Date of Patent: Jul. 23, 1996

[54] SNOWBOARD GLOVE WITH WRIST PROTECTION

[76] Inventor: Bryan D. Dorr, 1755 S. Hwy. 83, Franktown, Colo. 80116

[21] Appl. No.: 399,065

[22] Filed: Mar. 8, 1995

[51] Int. Cl.[6] ..... A41D 19/00

[52] U.S. Cl. ..... 2/161.1; 2/16

[58] Field of Search ..... 2/16, 20, 159, 2/160, 161.1, 162; 473/59, 62

[56] References Cited

U.S. PATENT DOCUMENTS

| | | | |
|---|---|---|---|
| 3,229,306 | 1/1966 | Bazar | 2/161.1 |
| 3,871,029 | 3/1975 | Hollman | 2/161.1 |
| 4,047,250 | 9/1977 | Norman | 2/161.1 |
| 4,190,906 | 3/1980 | Patton, Jr. | 2/162 |
| 4,228,548 | 10/1980 | Cohen | 2/161.1 |
| 4,958,384 | 9/1990 | McCrane . | |
| 5,014,689 | 5/1991 | Meunchen et al. | 2/16 |
| 5,313,667 | 5/1994 | Levine . | |
| 5,339,465 | 8/1994 | Kyewski | 2/20 |

*Primary Examiner*—Michael A. Neas
*Attorney, Agent, or Firm*—Dorr, Carson, Sloan & Birney

[57] ABSTRACT

A snowboard glove provides protection to the hand and wrist of the wearer. The glove includes a shell having a wrist portion, a palm portion, a back-of-hand portion, a thumb portion and a fingers portion. The shell is formed from at least an outer waterproof layer, an inner layer, and insulation between the outer and inner layers. A first elongated pouch is connected to the inner layer on the palm portion and is placed between the inner layer and the insulation. The first elongated pouch extends from the palm portion to the wrist portion of the glove. A second elongated pouch is connected to the inner layer on the back-of-hand portion and is positioned between the inner layer and the insulation. The second elongated pouch extends from the back-of-hand portion to the wrist portion of the glove. A first wrist support plate is securely mounted in the first pouch. A second wrist support plate is securely mounted in the second pouch. A reinforcement band in the glove shell connects to the ends of the first and second pouches away from the wrist portion for firmly holding the first and second wrist support plates in alignment in the first and second pouches.

11 Claims, 6 Drawing Sheets

SNOWBOARD GLOVE WITH WRIST PROTECTION

BACKGROUND OF THE INVENTION

1. Field of the Invention

This invention relates generally to wrist protectors and, more particularly, to a glove worn by a snowboard rider that incorporates wrist protection.

2. Statement of the Problem

Snowboarding is a sport with a high incident rate of wrist injuries.

One approach in providing wrist protection while snowboarding is U.S. Pat. No. 5,313,667, which provides a wrist pad for protecting the wrist of a snowboard rider from adverse rotation and consequent serious injury. The '667 patent sets forth a wrist pad to be worn over a glove. When the '667 wrist pad is worn, opposing wrist support plates on opposing sides of a hand are secured on the outside of the glove to provide wrist protection. The '667 patent utilizes four separate straps that selectively interconnect around the glove. These four straps, therefore, are exposed to adverse winter conditions and to ice and snow buildup during use. This requires the material to be made of waterproof material. Placing the wrist pad on the outside of the glove takes away from the appearance of the glove and takes away from the smooth outer surface of the glove that is desired for snowboarding and the like. Furthermore, this design by being on the outside of the glove does not provide as snug a fit to the hand as found, for example, in in-line skating wrist protectors, which are applied directly against the skin of the hand. Finally, the process of removing a glove is complicated since the wrist pad must first be removed by removing four straps and then removing the glove.

Hence, a need exists for a snowboard glove having integrally built into it wrist protection that provides a snug fit as close to the hand and wrist as possible and yet retains the smooth surface and aesthetic good looks of a conventional glove. The glove should be capable of being quickly put on and removed.

3. Solution to the Problem

The snowboard glove of the present invention solves the above-stated problem by internally incorporating wrist protection in a glove and positioning the internal wrist protection as snugly as possible to the hand and wrist while maintaining the smooth outer surface of the glove. Furthermore, the glove is easy to put on and to take off.

SUMMARY OF THE INVENTION

The snowboard glove of the present invention provides protection to the wrist in case the wearer of the glove suffers a fall while snowboarding. The wrist-protective snowboard glove includes a glove shell having a wrist portion, a palm portion, a back-of-hand portion, a thumb portion, and a fingers portion. The glove shell is formed from an outer waterproof layer, an inner layer, and insulation between the outer and inner layers. A first elongated pouch is connected to the inner layer on the palm portion and is placed between the inner layer and the insulation. The first elongated pouch extends from the palm portion to the wrist portion of the glove. A second elongated pouch is connected to the inner layer on the back-of-hand portion and is positioned between the inner layer and the insulation. The second elongated pouch extends from the back-of-hand portion to the wrist portion of the glove. The first and second pouches in the glove substantially oppose each other.

A first wrist support plate is securely mounted in the first pouch. The first pouch snugly fits around the first wrist support plate to prevent it from moving during a fall. A second wrist support plate is securely mounted in the second pouch. The second pouch also snugly fits around the second wrist support plate to prevent it from moving during a fall.

A reinforcement band in the glove shell connects to the ends of the first and second pouches oriented away from the wrist portion for firmly holding the first and second wrist support plates in alignment in the first and second pouches. The reinforcement band is connected to the inner layer of the shell, and the reinforcement band is located near the region where the thumb portion of the glove connects to the glove shell. The reinforcement band minimizes twisting of the support plates during a fall.

An opening is formed in the wrist portion of the glove on the side opposing the thumb portion that allows the wearer of the glove to insert his hand into the glove. A flexible material covers the opening. A strap connected to one side of the wrist region of the glove wraps around the wrist region for selectively closing the opening when the wearer places his hand into the glove. The strap is securely coupled to the wrist region for firmly holding the ends of the first and second support plates away from the palm and back-of-hand portions against the wrist of the wearer when the wearer wears the glove. The strap also minimizes twisting of the support plates during a fall.

DETAILED DESCRIPTION OF THE PREFERRED EMBODIMENT

1. Overview.

Figure 1:
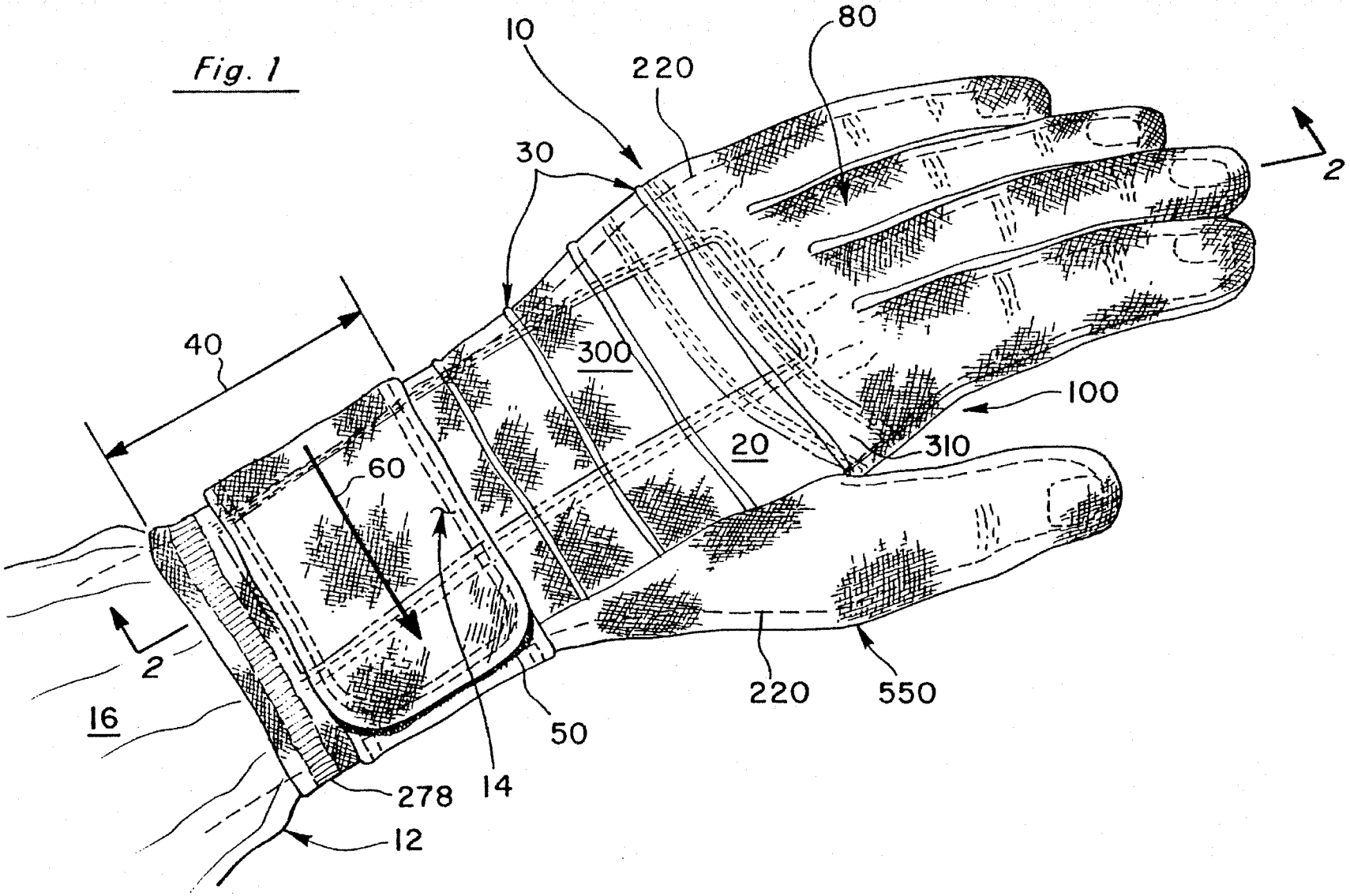
FIG. 1 is a perspective view of the snowboard glove of the present invention.

In FIG. 1, the perspective view of the glove 10 of the present invention being worn by a wearer 12 is shown. The glove 10 has an external surface 20 incorporating any pleasing aesthetic design 30 that is desired. The glove 10 of the present invention, in fact, can carry any conventional surface or design. The glove 10 has a wrist portion 40, a palm portion 100, a back-of-hand portion 300, a thumb portion 550, and a fingers portion 80. The glove 10 has an extended wrist region or cuff 40 to fully cover the wrist 14 and a portion of the forearm 16 of the wearer 12. In the extended region 40 is a wrist strap 50 that affixes over the wrist 14 of the wearer 12 in the direction of arrow 60. The strap 50 is attached conventionally to the glove 10 such as, for example, by means of VELCRO fasteners. Any conventional fastening, however, could be utilized for strap 50 such as buckles, etc. A conventional constriction band 278 could also be used to keep snow out from the inside of the glove 10.

Little snow buildup will occur on the snowboard glove 10 of the present invention during use and the wrist protection is hidden from view. As illustrated in FIG. 1 and from the outer appearance of the gloves no one would realize the glove has a wrist protector internal thereto.

2. Support Plates.

Figure 2:
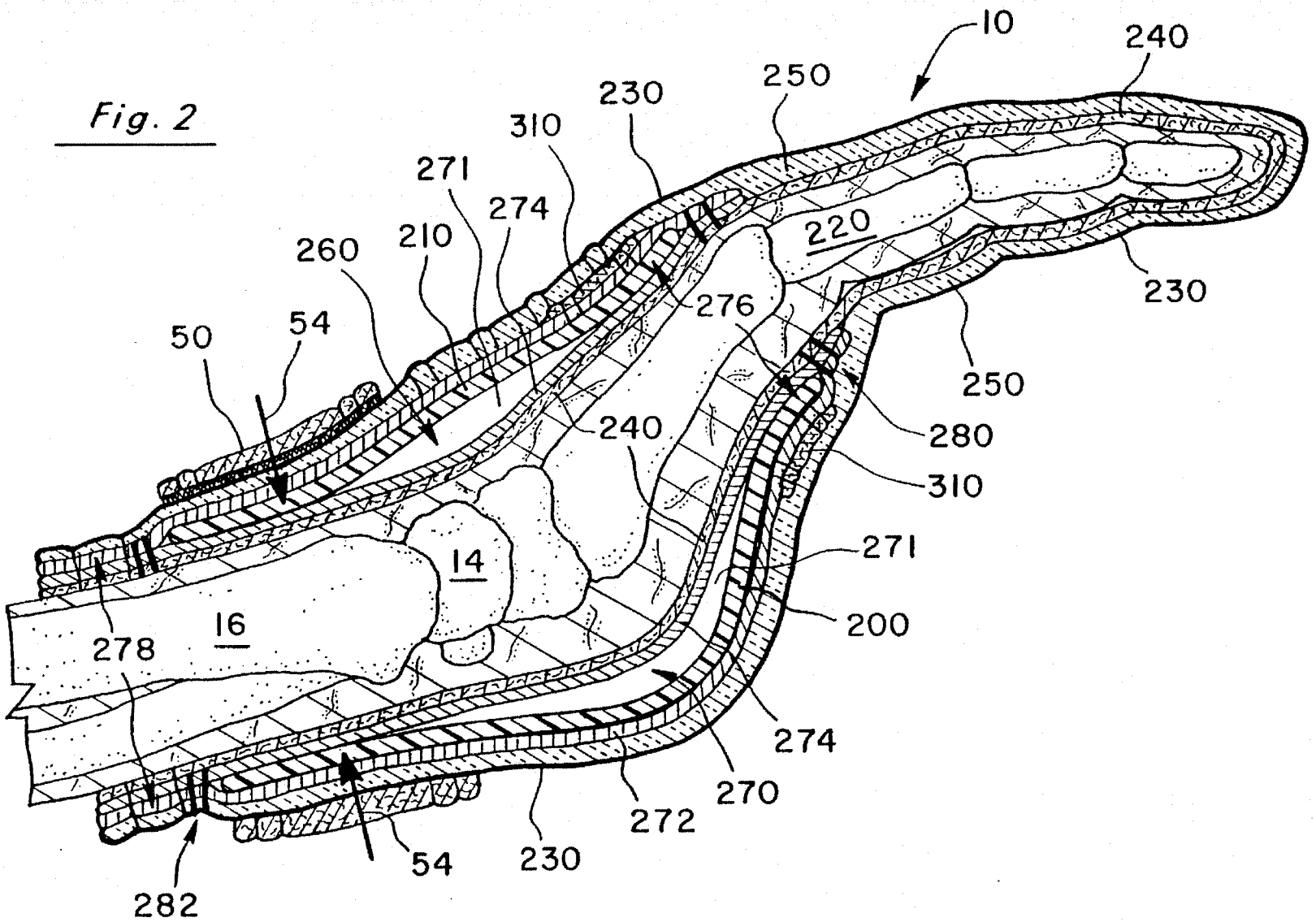
FIG. 2 is a cross-sectional illustration showing the positioning of the front and back support plates within the glove.

In FIG. 2, the front support plate 200 and the rear support plate 210 are illustrated in position on opposing sides of the hand 220. The design of the front and rear support plates 200 and 210 is conventional as found, for example, in rollerblade wrist guards. Any suitably designed support plates 200 and 210 could be utilized under the teachings of this invention, and the angular shape as well as the peripheral shape of the support plates 200 and 210 could be changed without departing from the spirit of the present invention. Such support plates are conventionally made of material that is semi-flexible, but with ample longitudinal stiffness to support the wrist of the wearer during a fall. The design of the support plates 200 and 210 may vary based on the age or weight of the wearer.

3. Glove.

The glove 10 of the present invention has a conventional waterproof outer liner 230 that is typically nylon, leather, canvas, or other synthetic, natural, or blends of fiber, and may be plastic-coated. The inside layer 240 is typically a smooth material, such as a relatively soft textile fabric or a pile polypropylene blend with the pile facing the interior of the glove, which is comfortable and soft to the touch and which is preferably porous to water. Between the outer shell 230 and the inner shell 240 is an appropriate layer or layers of insulation material 250. The insulation 250 may be made of any suitable material such as lofting material, down, foam, synthetic, or natural fibers, etc. The wrist protection of the present invention can be integrated into any conventional snowboard glove under the teachings of the present invention, and the construction of the glove itself is conventional and may include at least three layers: the inner layer 240, the insulation 250, and the outer layer 230. It is to be expressly understood that the layer of insulation 250 can be bonded to either the inner layer 240 or the outer layer 230. Furthermore, the glove could have a removable inner lining, not shown, in that case the protective wrist apparatus of the present invention would be integrated with the removable inner lining.

4. Pouches.

Figure 3:
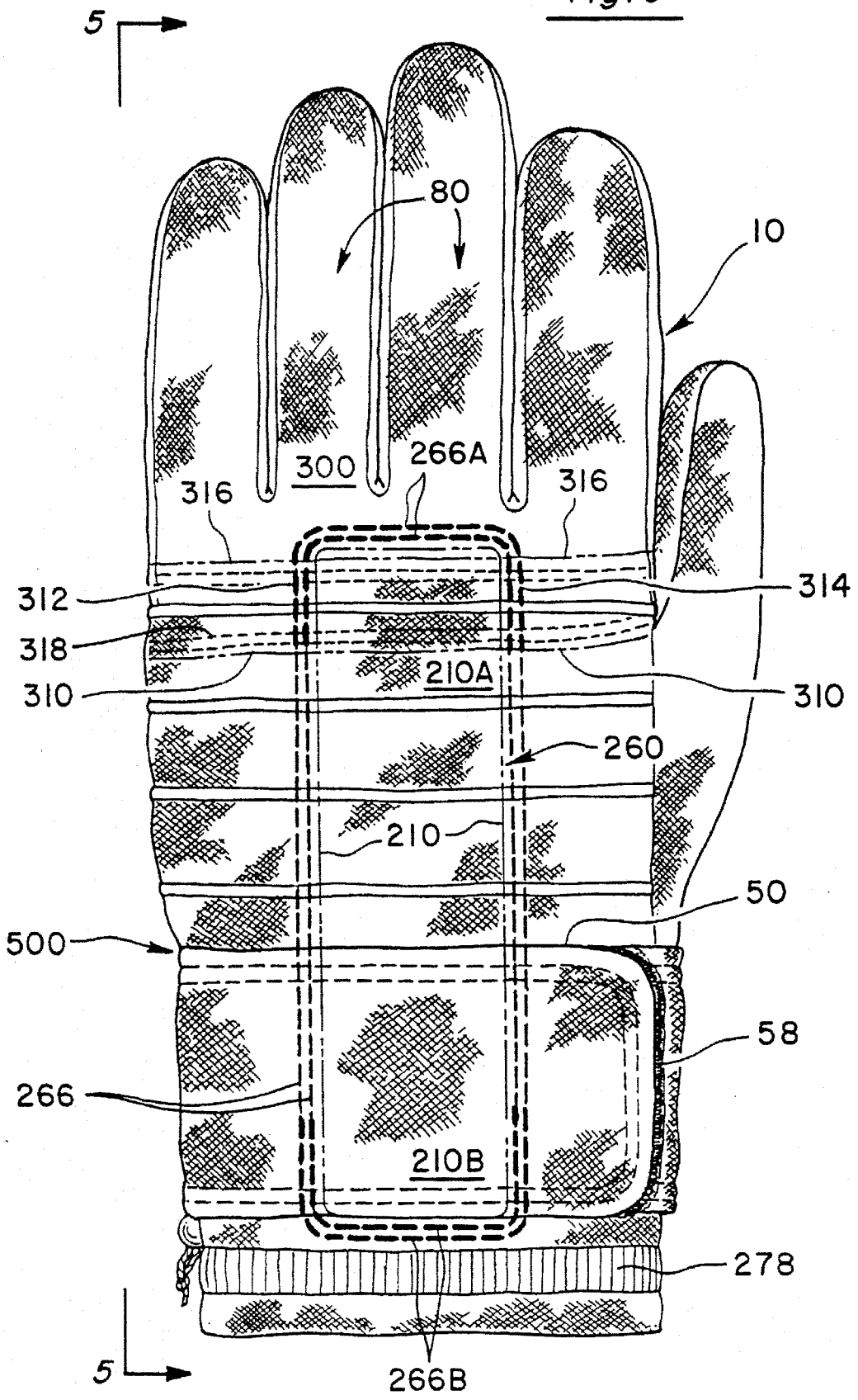
FIG. 3 is a top planar view of the glove of the present invention showing the positioning of the back support plate.
Figure 4:
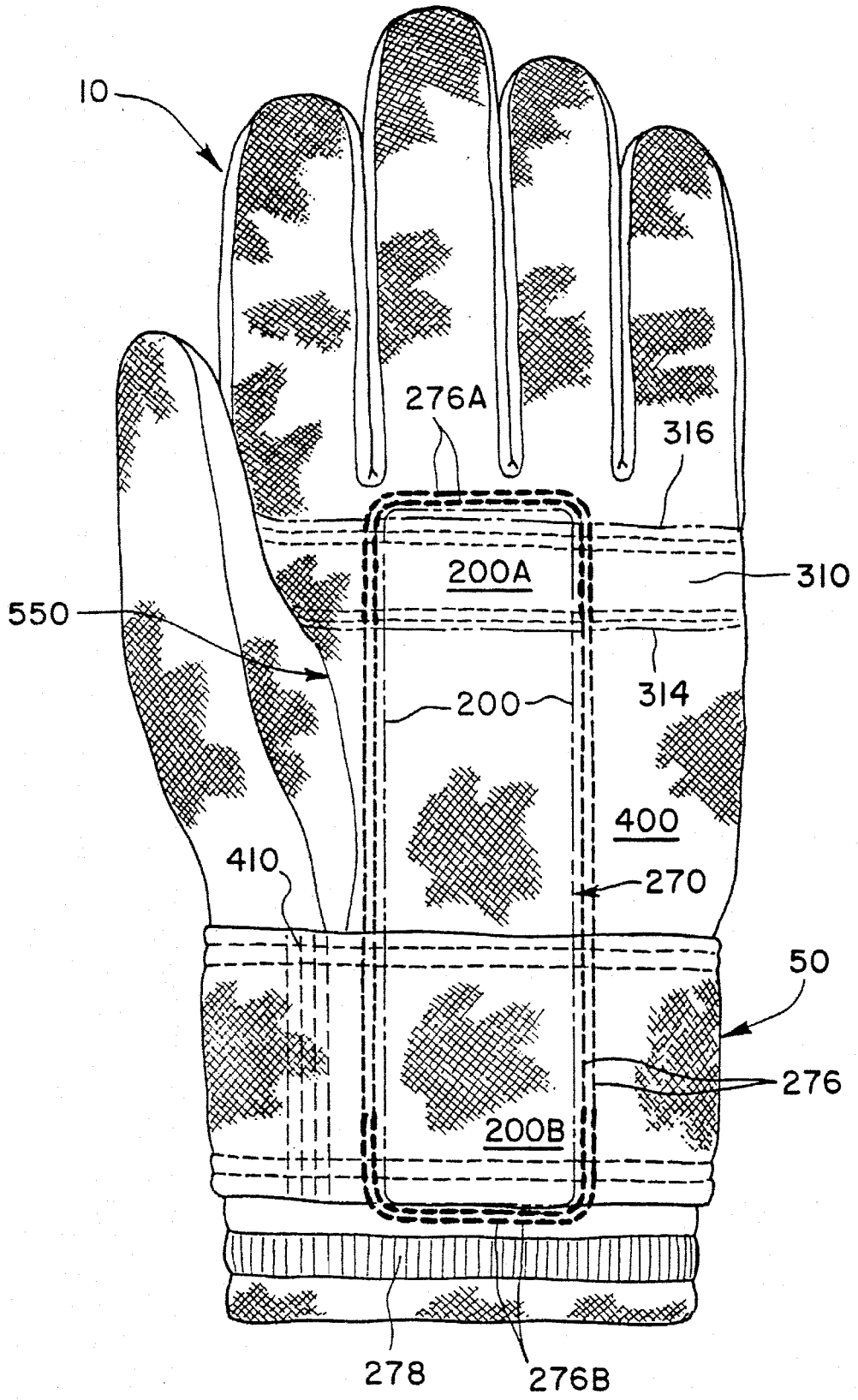
FIG. 4 is a front planar view of the glove of the present invention showing the orientation of the front support plate.

As shown in FIGS. 2 through 4, each support plate 200 and 210 is contained within pouches 260 and 270. The pouch 270 is preferably formed from two types of material. The outer retaining layer 272 (furthest from the hand) is formed from a stronger material such as leather or dense nylon, and the inner padded layer 274 (closest to the hand) is formed of a softer material such as neoprene. An air space 271 may exist in pouch 270 in certain orientations of the hand. The purpose of the softer material 274 on the inside surface of the pouch 270 is to make the support plate 200 comfortable to the wearer 12 of the glove 10. In some designs, under the teachings of the present invention, the layer 274 could be eliminated and the inner layer 240 could be made thicker. In this case, the pouch 270 would be formed by the layer 240 sewn at areas 280 and 282 to layer 274. Likewise, layer 274 could be eliminated and the pouch 270 could be formed by either layer 250 or layer 230 sewn at areas 280 and 282. In another equivalent design, the pouch 270 could simply be formed by the inner layer 240 and the outer layer 230 sewn together at areas 280 and 282. Here, the insulation 250 could be located on either side of the support plate 200 or on both sides. In the above equivalent designs, the support plate 200 is secured in the interior of the glove 10.

Pouch 270 is preferably attached to the glove 10 throughout the entire periphery of the pouch as shown by stitches 276. However, pouch 270 does not need to be entirely stitched around since only the upper and lower U-shaped ends 276 and 276B need to be stitched to the glove 10 as illustrated by the darkened stitches. When firmly stitched the support plates 200 and 210 are prevented from twisting so as to stay aligned with the hand and wrist especially during a fall.

Pouch 260 with stitching 266 and ends 266A and 266B is similar in construction to pouch 270. While stitching is preferred herein, any equivalent form of attachment or mounting could be used, such as glue, double-sided tape, etc.

With reference back to FIGS. 1 and 2, when the wrist strap 50 is firmly wrapped around the arm 16 of the wearer 12 in region 40, the support plates 200 and 210 are firmly held against the arm 16 and wrist 14 of the wearer 12 as shown by arrows 54. The strap 50 firmly holds the support plates 200 and 210 in place during wearing of the snowboard glove 10 of the present invention.

5. Reinforcement Band.

In FIG. 3, the back-of-hand portion 300 of the glove 10 is shown. The rear support plate 210 is firmly held in place by pouch 260 and stitching 266. A reinforcement band 310 of stronger material such as nylon sewn around the glove may be further provided. The reinforcement band 310 could simply be a continuation of the material comprising the outer layer 272 of the pouch 270 and is sewn at stitches 316 and 318 to the inner lining 240 (except in the area of the support plates 200 and 210). This reinforcement band 310 is optional and aids in maintaining the upper ends 200A and 210A of support plates 200 and 210 in proper alignment with the hand, wrist, and forearm of the wearer 12. The band 310 may be provided all the way around the glove 10 or only partially around, but should at least connect the support plates 200 and 210 near where the thumb portion 550 connects to the glove 10.

In FIG. 4, the palm portion 100 of the glove 10 of the present invention is shown. The front support plate 200 is snugly fit within pouch 270. Again, the reinforcement band 310 interconnects with the top 200A of the support plate 200 to positively hold the support plate 220 with the hand, wrist, and arm and to prevent twisting. The strap 50 is shown sewn onto the glove at region 410.

The upper ends 200A and 210A of the support plates 200 and 210, in a simplified embodiment of the present invention, may be affixed directly to the reinforcement band 310 such as through adhesive, double-sided tape, or other equivalent bonding means. The band 310 can be affixed to the inner liner 240 so that the ends 200A and 210A are oriented between the band 310 and the outer layer 230. In this embodiment, the structure sequence is: inner layer 240, band 310 affixed to inner layer 240, ends 200A and 210A affixed to band 310, insulation 250, and outer layer 230. Other structure sequences could include: padding 274 between layer 240 and band 310; the band 310 affixed to the outer layer 230; etc. All of the embodiments of the present invention provide for the secure mounting of the support plates 200 and 210 between the inner and outer layers 240 and 230 of the glove 10.

6. V-Shaped Opening.

Figure 5:
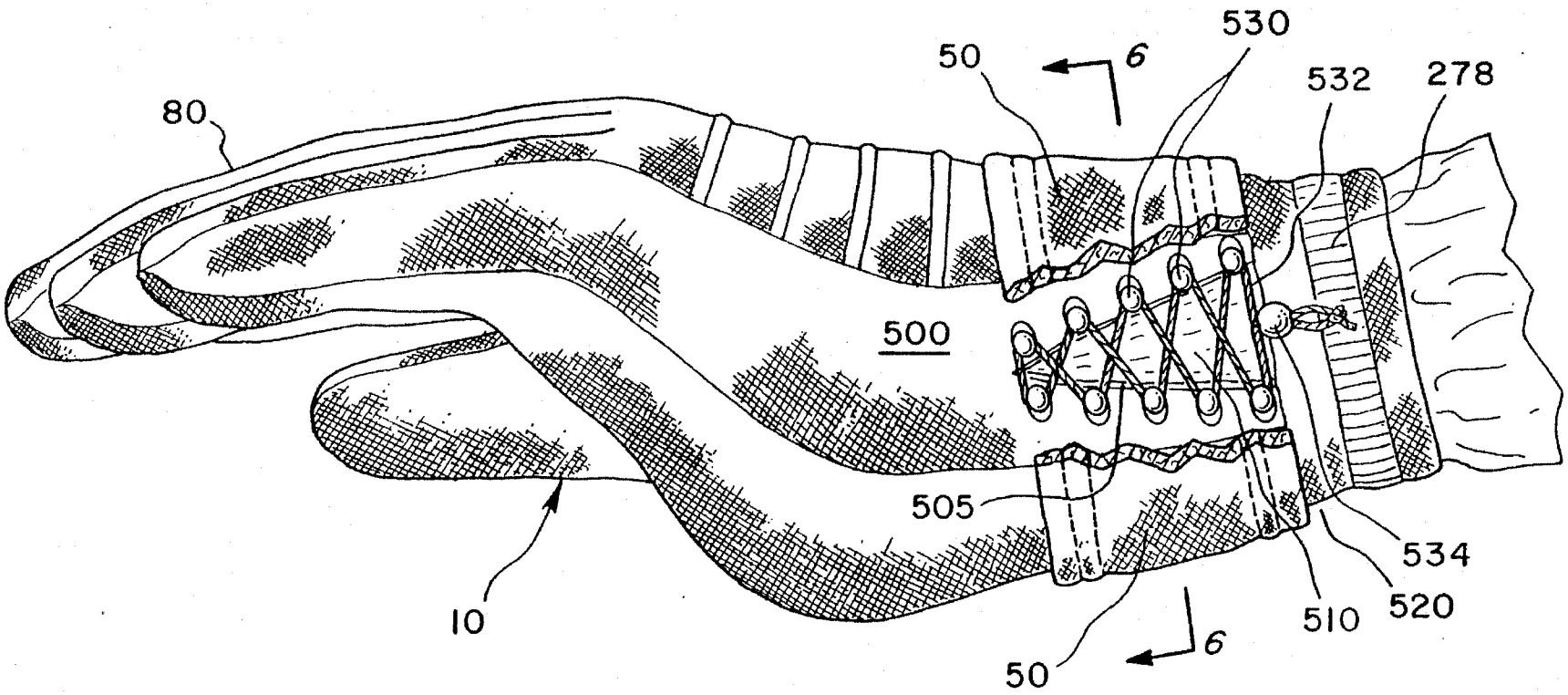
FIG. 5 is a side planar view of the glove of the present invention showing the formed V-slot opening and the wrist strap of the present invention.

In FIG. 5, the side 500 of glove 10 is shown having a formed V-shaped opening 505 with a thin flexible web 510 such as soft leather. This type of design is common and allows the hand to fit through the wrist region 520 of the glove. Once the hand is inserted into the glove, the wrist region 520 is tightened down. In the embodiment shown in FIG. 5, a hook 530 and lace 532 design is shown wherein a conventional snap lock 534 can be selectively activated and the lace 532 pulled through the snap lock 534 to tighten up the V-shape region 500 about the wrist 14.

Figure 6A:
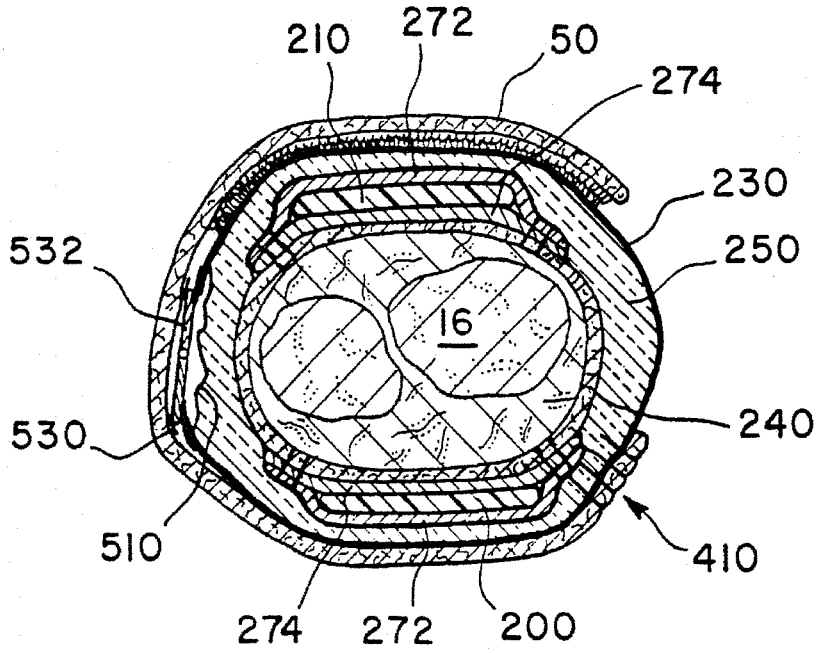
FIGS. 6A and 6B are cross-sectional views along lines 6—6 of FIG. 5 showing the engagement of the wrist strap.
Figure 6B:
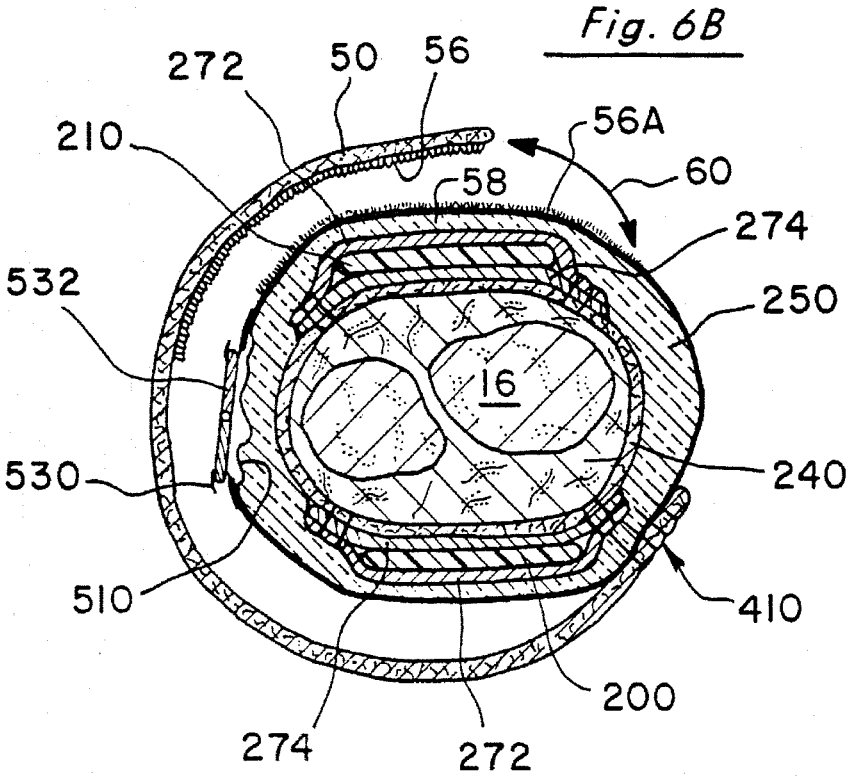

As shown in FIGS. 6A and 6B, the strap 50 having VELCRO 56 is then lifted over the V-shape region 505 and, as shown in FIG. 1, engages other VELCRO 56A placed on the back of the glove 10 in the region 58.

It is to be understood that the hook 530 and lace 532 design shown in FIG. 5 is optional under the teachings of the present invention but is provided when added support to the wrist area is needed.

While a V-shaped formed opening is preferred, any equivalent structure could be used to provide ease of hand entry into the glove under the teachings of the present invention. For example, the wrist region of the glove could be formed of elastic around in circumference so that the hand could be simply inserted. The strap 50 could then be affixed to provide the snug or firm grip around the wrist 14 to hold the lower ends of the support plates 200 and 210 when worn.

7. Operation.

In operation, therefore, the laces 532 are loose and the strap 50 is not connected. The wrist region 520 of the glove is expanded and the hand 220 of the wearer 12 is inserted. Under the teachings of the present invention, the wrist region 510 is opposite the thumb portion 550 of the glove. This is clearly shown in FIG. 5. Once the hand is inserted into the glove, the lace 532 is pulled tight and latched in the lock 534.

As shown in FIGS. 6A and 6B, the strap 50 is then pulled firmly in the direction of arrow 60 around the wrist region 520 to substantially encircle the wrist 14 to firmly engage the bottoms of the front and back support plates 200 and 210 against the wrist 14 and forearm 16. Hence, when the wearer 12 puts on the glove 10 of the present invention, the bottoms 200B and 210B of the support plates 200 and 210 are firmly held in place and the upper ends 200A and 200B of the support plates are firmly held in place with the reinforcement band 310. Hence, the support plates 200 and 210 are held against the hand and wrist and are in position should an accident occur applying pressure to the wrist. For all purposes, the snowboard glove 10 of the present invention appears to be a normal snowboard glove with the wrist protection found integrally and internally to the glove as illustrated in FIG. 5.

It is to be expressly understood that the claimed invention is not to be limited to the description of the preferred embodiment but encompasses other modifications and alternations within the scope and spirit of the inventive concept. For example, while stitching has been disclosed, other conventional bonding approaches could be used such as heat, gluing, etc. Likewise, the teachings of the present invention could be incorporated into conventional winter or ski gloves.

I claim:

1. A wrist protection snowboard glove for the hand and wrist of a wearer, said wrist protection snowboard glove comprising:

a glove shell, said glove shell having at least a wrist portion, a palm portion, a back-of-hand portion, and a thumb portion, said shell formed from at least an outer layer, an inner layer, and insulation between said inner and outer layers, a first elongated pouch attached at least at opposing ends thereof to said inner layer and between said inner layer and said insulation, said first elongated pouch extending from said palm portion to said wrist portion, said first elongated pouch having a padded layer adjacent to said inner layer and a retaining layer, a second elongated pouch attached at least at opposing ends thereof to said inner layer and between said inner layer and said insulation, said second elongated pouch extending from said back-of-hand portion to said wrist portion, said first and second elongated pouches substantially opposing each other in said glove, said second elongated pouch having a padded layer adjacent to said inner layer and a retaining layer, a first wrist support plate securely mounted between said padded layer and said retaining layer of said first pouch, said first pouch snugly fitting at least at said opposing ends thereof around said first wrist support plate, a second wrist support plate securely mounted between said padded layer and said retaining layer of said second pouch, said second pouch snugly fitting at least at said opposing ends thereof around said second wrist support plate, a strap connected to one side of said wrist portion and wrapping around said wrist portion for firmly holding the ends of said first and second support plates away from said palm and back-of-hand portions against said wrist of said wearer when said wearer wears said glove.

2. The wrist protection snowboard glove of claim 1 further comprising:

a reinforcement band in said glove shell connecting to the ends of said first and second pouches away from said wrist portion for firmly holding said first and second wrist support plates in alignment in said first and second pouches, said reinforcement band connected to said inner layer, said reinforcement band located near the region of where the thumb portion connects to the glove shell.

3. The wrist protection snowboard glove of claim 1 further comprising:

an opening in the wrist portion of said glove on the side opposing said thumb portion, flexible material covering said opening, said strap selectively closing said opening around said wrist when said wearer wears said glove.

4. The wrist protection snowboard glove of claim 3 further comprising a hook and lace tiedown engaging said wrist portion for selectively closing said opening.

5. A wrist protection glove for the hand and wrist of a wearer using said wrist protection glove in snow, said wrist protection glove comprising:

a glove shell, said glove shell covering all of said hand, said glove shell having a wrist portion, a palm portion, a back-of-hand portion, and a thumb portion, said shell formed at least an outer layer and an inner layer, a first elongated wrist support plate securely mounted to said glove shell between said inner layer and said outer layer, said first elongated wrist support plate extending from said palm portion to said wrist portion, a second elongated wrist support plate securely mounted to said glove shell between said inner layer and said outer layer, said second elongated wrist support plate extending from said back-of-hand portion to said wrist portion, said first and second elongated wrist support plates substantially opposing each other in said glove, a strap securely coupling to said wrist portion for firmly holding said first elongated support plate against said palm portion and said wrist portion and said second elongated support plate against said back-of-hand portion and said wrist portion between said inner and outer layers when said wearer wears said glove over said hand, said strap securely holding said glove shell to said hand to keep said snow from said hand.

6. A wrist protection glove for the hand and the wrist of a wearer, said wrist protection glove comprising:

a glove shell, said said glove shell at least having a wrist portion, a palm portion, a back-of-hand portion, and a thumb portion, said shell formed from at least an outer layer and an inner layer, a first elongated wrist support plate securely mounted to said glove shell between said inner layer and said outer layer, said first elongated wrist support plate extending from said palm portion to said wrist portion, a second elongated wrist support plate securely mounted to said glove shell between said inner layer and outer layer, said elongated wrist support plate extending from said back-of-hand portion to said wrist portion, said first and second elongated wrist support plates substantially opposing each other in said glove, a strap securely coupling to said wrist portion for firmly holding the ends of said first and second elongated support plates away from said palm and back-of-hand portion against said wearer when said wearer wears said glove, a reinforcement band in said glove shell connecting to the ends of said first and second elongated wrist support plates away from said wrist portion for firmly holding said first and second elongated wrist support plates, said reinforcement band connected to said glove shell, said reinforcement band located near the region of where the thumb portion connects to the glove shell.

7. The wrist protection glove of claim 5 further comprising means connected to said inner layer of said glove shell for holding said first elongated wrist support plate.

8. A wrist protection glove for the hand and wrist of a wearer, said wrist protection glove comprising:

a glove shell, said glove shell at least having a wrist portion, a palm portion, a back-of-hand portion, and a thumb portion, said shell formed from at least an outer layer and an inner layer, a first elongated wrist support plate securely mounted to said glove shell between said inner layer and said outer layer, said first elongated wrist support plate extending from said palm portion to said wrist portion, a second elongated wrist support plate securely mounted to said glove shell between said inner layer and said outer layer, said second elongated wrist support plate extending from said back-of-hand portion to said wrist portion, said first and second elongated wrist support plates substantially opposing each other in said glove, a strap securely coupling to said wrist portion for firmly holding the ends of said first and second elongated support plates away from said palm and back-of-hand portions against said wrist of said wearer when said wearer wears said glove, means connected to said inner layer of said glove shell for holding said first elongated wrist support plate, wherein said holding means is an elongated pouch snugly fitting around said first elongated wrist support plate.

9. The wrist protection glove of claim 5 further comprising means connected to said inner layer of said glove for holding said second elongated wrist support plate.

10. A wrist protection glove for the hand and wrist of a wearer, said wrist protection glove comprising:

a glove shell, said glove shell at least having a wrist portion, a palm portion, a back-of-hand portion, and a thumb portion, said shell formed from at least an outer layer and an inner layer, a first elongated wrsti support plate securely mounted to said glove shell between said inner layer and said outer layer, said first elongated wrist support plate extending from said palm portion to said wrist portion, a second elongated wrist support plate securely mounted to said glove shell between said inner layer and said outer layer, said second elongated wrist support plate extending from said back-of-hand portion to said wrist portion, said first and second elongated wrist support plates substantially opposing each other in said glove, a strap securely coupling to said wrist portion for firmly holding the ends of said first and second elongated support plates away from said palm and back-of-hand portions against said wrist of said wearer when said wearer wears said glove, means connected to said inner layer of said glove for holding said elongated wrist support plate, wherein said holding means is an elongated pouch snugly fitting around said second elongated wrist support plate.

11. A wrist protection snowboard glove for the hand and wrist of a wearer, said wrist protection snowboard glove comprising:

a glove shell, said glove shell having at least a wrist portion, a palm portion, a back-of-hand portion, and a thumb portion, said shell formed from at least an outer layer, an inner layer, and insulation between said inner and outer layers, a first elongated pouch attached at least at opposing ends thereof to said inner layer and between said inner layer and said insulation, said first elongated pouch extending from said palm portion to said wrist portion, said first elongated pouch having a padded layer adjacent to said inner layer and a retaining layer, a second elongated pouch attached at least at opposing ends thereof to said inner layer and between said inner layer and said insulation, said second elongated pouch extending from said back-of-hand portion to said wrist portion, said first and second elongated pouches substantially opposing each other in said glove, said second elongated pouch having a padded layer adjacent to said inner layer and a retaining layer, a first wrist support plate securely mounted between said padded layer and said retaining layer of said first elongated pouch, said first elongated pouch snugly fitting at least at said opposing ends thereof around said first wrist support plate, a second wrist support plate securely mounted between said padded layer and said retaining layer of said second elongated pouch, said second elongated pouch snugly fitting at least at said opposing ends thereof around said second wrist support plate, a strap connected to one side of said wrist portion and wrapping around said wrist portion for firmly holding the ends of said first and second support plates away from said palm and back-of-hand portions against said wrist of said wearer when said wearer wears said glove, a reinforcement band in said glove shell connecting to the ends of said first and second pouches away from said wrist portion for firmly holding said first and second wrist support plates in alignment in said first and second elongated pouches, said reinforcement band connected to said inner layer, said reinforcement band located near the region of where the thumb portion connects to the glove shell, a formed opening in the wrist portion of said glove on the side opposing said thumb portion, flexible material covering said formed opening, said strap selectively closing said opening around said wrist when said wearer wears said glove, a hook and lace tiedown engaging said wrist portion for selectively closing said opening.

* * * * *